US006899505B2

(12) United States Patent
Hataya

(10) Patent No.: US 6,899,505 B2
(45) Date of Patent: May 31, 2005

(54) BINDING MACHINE WITH TAPE

(76) Inventor: Hiroshi Hataya, c/o Taiyo Seiko Co., Ltd., 3-7, Hino 4-chome, Daito-shi, Osaka 574-0062 (JP)

( * ) Notice: Subject to any disclaimer, the term of this patent is extended or adjusted under 35 U.S.C. 154(b) by 312 days.

(21) Appl. No.: 10/176,652

(22) Filed: Jun. 24, 2002

(65) Prior Publication Data

US 2003/0007848 A1 Jan. 9, 2003

(30) Foreign Application Priority Data

Jul. 6, 2001 (JP) ..... 2001-206692

(51) Int. Cl.[7] ..... B42B 5/04
(52) U.S. Cl. ..... 412/36; 412/9; 412/902
(58) Field of Search ..... 412/9, 36, 37, 412/902

(56) References Cited

U.S. PATENT DOCUMENTS

2003/0007848 A1 * 1/2003 Hataya ..... 412/36

FOREIGN PATENT DOCUMENTS

| | | |
|---|---|---|
| EP | 1273520 | * 1/2003 |
| JP | 49-089184 | 11/1947 |
| JP | 56-151619 | 11/1981 |
| JP | 04114819 | 4/1992 |
| JP | 06-054505 | 7/1994 |
| JP | 07-040405 | 7/1995 |

* cited by examiner

*Primary Examiner*—Monica S. Carter
(74) *Attorney, Agent, or Firm*—Rabin & Berdo, P.C.

(57) ABSTRACT

A binding machine with a tape comprises a table for putting a material to be bound, a tape passage groove formed on the table, and a guiding member in an arch shape provided above the tape passage groove. A loop formed by a tape of a predetermined size is formed along the guiding member. There is provided a tape receiving member which can be displaced to first and second positions. At least a part of the tape receiving member at the first position advances into the loop, to prevent the top of the loop from hanging.

11 Claims, 4 Drawing Sheets

BINDING MACHINE WITH TAPE

CROSS REFERENCE TO RELATED APPLICATION

This application claims priority benefits under 35 USC § 119 of Japanese Patent Application Serial No.2001-206692, the disclosure of which is incorporated by reference.

BACKGROUND OF THE INVENTION

1. Field of the Invention

The present invention relates to a binding machine with a tape, in which a loop is formed by the tape, and the loop is tightened, to bind a material to be bound.

2. Description of Related Arts

Conventional small-sized binding machines for binding bills or the like includes one for winding a binding tape. Such a tape has at least one surface with thermal adhesive properties. The machine winds the tape around a material to be bound, overlaps an outer surface of its winding start portion and an inner surface of its winding end portion with each other, presses a heating and pressing portion heated by a heater against an overlapped portion, and heats and bonds the overlapped portion by thermoplastic resin applied to the tape, to bind the material to be bound.

in the binding machine, a small loop is formed at an end of the tape delivered from a tape roll held in the machine so as to be rotatable. A loop of a predetermined size along a guide path in an arch shape is formed by feeding the tape from the tape roll. The loop of the predetermined size is then tightened, to bind the material to be bound arranged in the loop.

Examples of the tape used for the binding are various types of tapes, for example, tapes made of paper and a plastic film. Among the tapes, a flexible one is also included.

When such a flexible tape is employed, the top of the loop of the predetermined size hangs immediately after the loop is formed, so that the shape of the loop of the predetermined size may be lost. When the shape of the loop is lost, it is difficult to arrange the material to be bound in the loop.

As a result, the top of the loop must be lifted in order for a user to arrange the material to be bound in the loop, thereby significantly reducing the efficiency of binding work.

SUMMARY OF THE INVENTION

Therefore, an object of the present invention is to provide a binding machine with a tape, which can reliably prevent the shape of a loop of a predetermined size formed by a tape from being lost by expansion and efficiently perform a binding operation.

In order to attain the above-mentioned object, in an aspect of the present invention, a binding machine with a tape binds a material to be bound arranged inside a loop formed by a tape by contracting the loop. The machine comprises a tape traveling mechanism that can cause the tape to travel in order to expand and contract the loop formed by the tape, a table on which the material to be bound can be mounted, a tape passage groove formed on the table, and a guiding member in an arch shape provided above the tape passage groove. The guiding member regulates the expanded loop to a predetermined size from the outside of the expanded loop. Further, the binding machine with a tape comprises a tape receiving member that can be displaced to a first position where at least a part thereof advances into the expanded loop to prevent the tape at the top of the loop from hanging and a second position where it retreats outward from the expanded loop, and a driving mechanism that drives the tape receiving member in order to displace the tape receiving member to the first and second positions.

In this aspect, after the loop of the predetermined size is formed by the tape along the guiding member, the tape receiving member which has advanced to the first position prevents the top of the loop from hanging. Consequently, the shape of the loop of the predetermined size can be reliably maintained, thereby making it possible to smoothly arrange the material to be bound in the loop and efficiently perform the binding operation.

DETAILED DESCRIPTION OF THE PREFERRED EMBODIMENT

A preferred embodiment of the present invention will be described while referring to the accompanying drawings.

Figure 1:
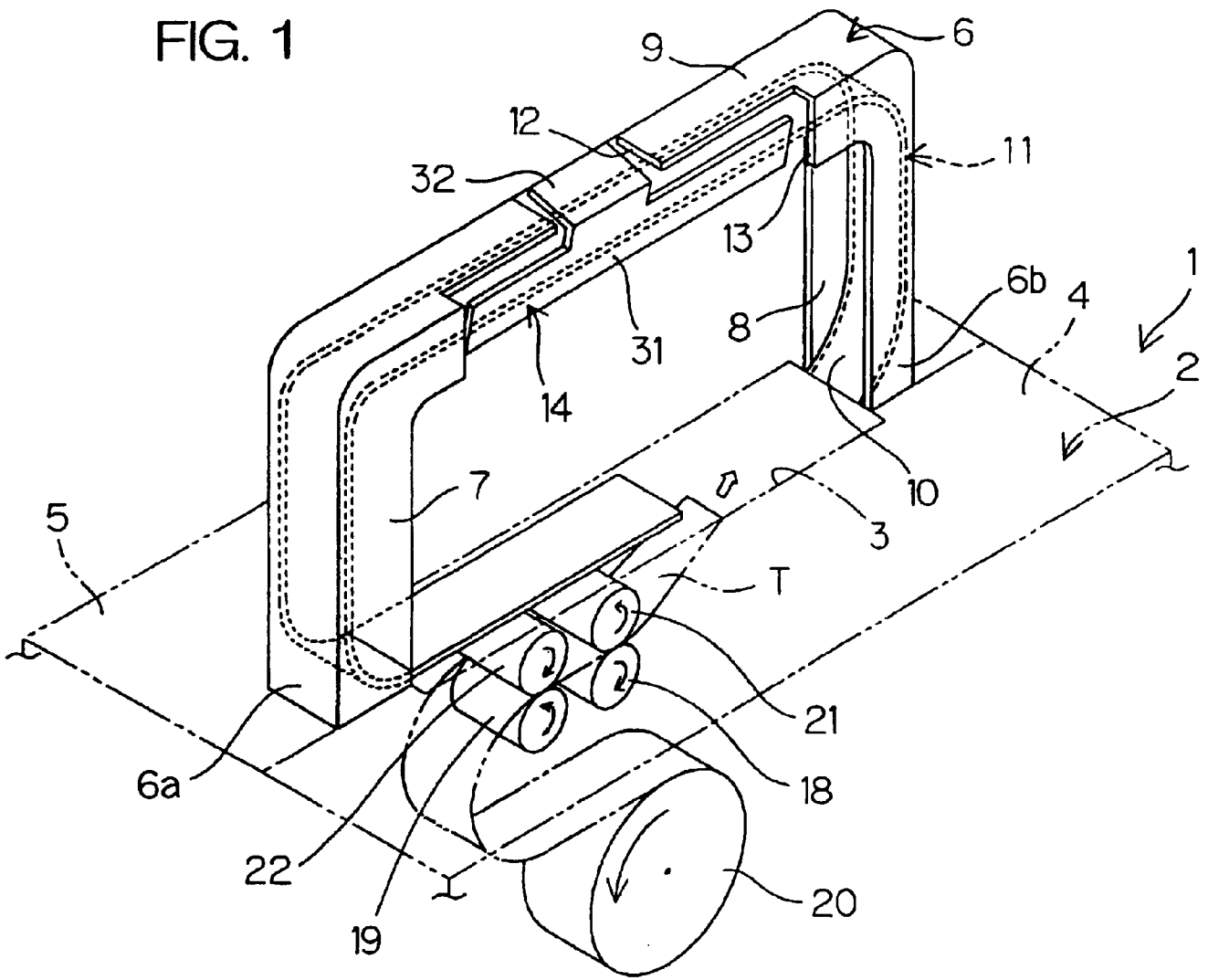
FIG. 1 is a partially broken perspective view showing a principal part of a binding machine with a tape according to an embodiment of the present invention.

FIG. 1 illustrates a principal part of a binding machine with a tape according to an embodiment of the present invention. Referring to FIG. 1, an upper surface of the main body of a binding machine 1 is formed by a table 2 for receiving a material to be bound. The table 2 is divided into a front table 4 and a rear table 5 with a groove 3 serving as a tape path interposed therebetween. Legs 6*a* and 6*b* of a guide frame 6 in an arch shape arranged above the table 2 are respectively fixed to both ends of the groove 3. The guide frame 6 has a ⊐ shape (a so-called groove shape) in cross section having a pair of flanges 7 and 8 and a web 9 connecting the flanges 7 and 8 to each other. A front sidewall and a rear sidewall of the guide path 10 are respectively composed of the pair of flanges 7 and 8.

Furthermore, a guiding member 11 composed of an arch-shaped plate, for example, for guiding an outer surface (a curved outer surface) of a tape T, having thermal adhesive properties, which travels in order to form a loop is arranged inside the guide frame 6. The guiding member 11 constitutes an outer peripheral wall of the guide path 10.

The web 9 of the guide frame 6 is in the shape of an arch. However, a nicked recess 12 is formed at the center of a top plate of the web 9, and a longitudinal nicked recess 13 is similarly formed in an upper part of an arch of the front flange 7 forming an arch shape so as to connect with the nicked recess 12. A tape receiving member 14 is arranged in the nicked recesses 12 and 13. The tape receiving member 14 is driven by a driving mechanism 15 shown in FIG. 2.

Figure 2A:
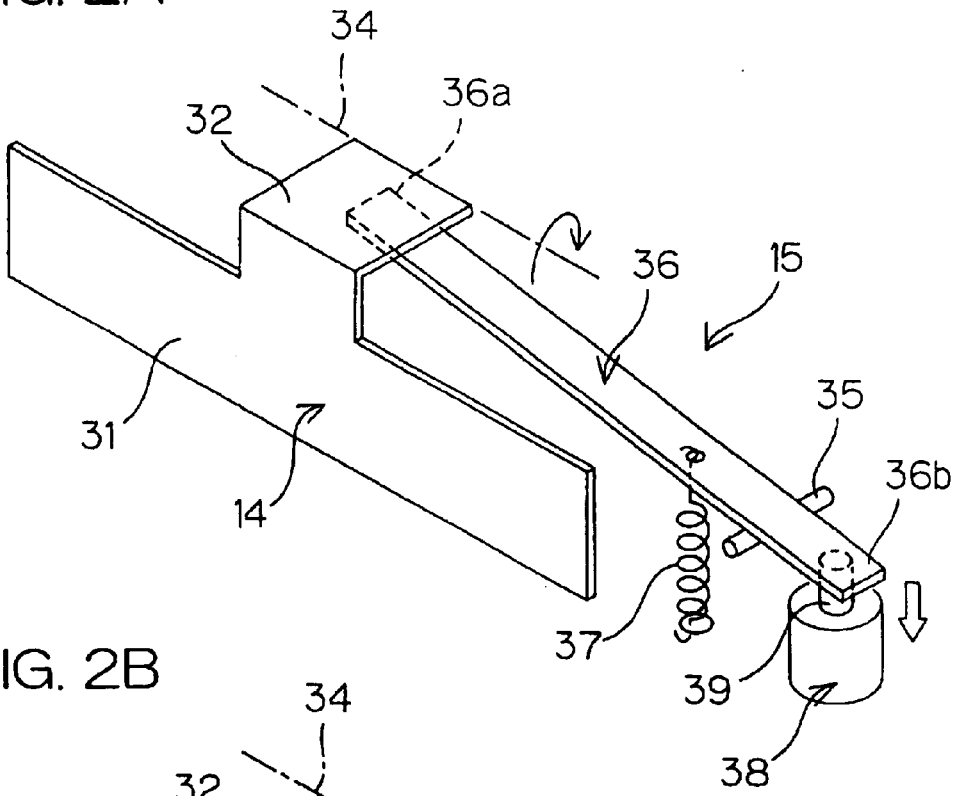
FIGS. 2A and 2B are schematic perspective views each showing the operations of a tape receiving member and a mechanism for driving the tape receiving member.
Figure 2B:
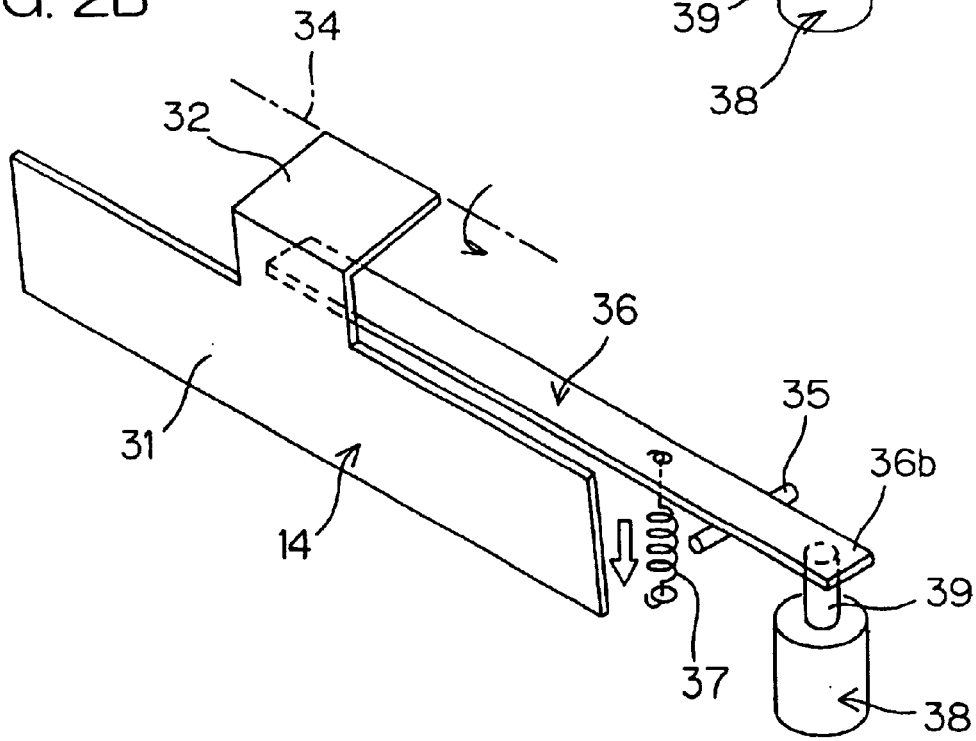

Referring to FIG. 1 and FIGS. 2A and 2B, the tape receiving member 14 has a swingable side plate 31 forming an inversed T shape and an upper plate 32 extending in a direction crossing the swingable side plate 31, for example, in a direction approximately perpendicular thereto from an upper end of the swingable side plate 31.

Figure 3A:
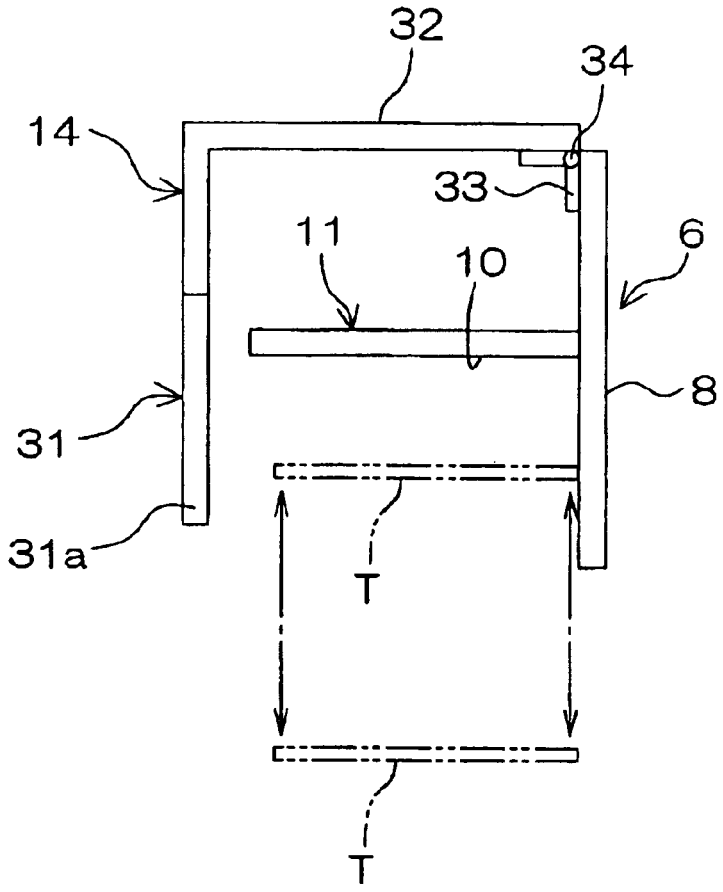
FIGS. 3A and 3B are schematic cross-sectional views each showing the operations of a tape receiving member.
Figure 3B:
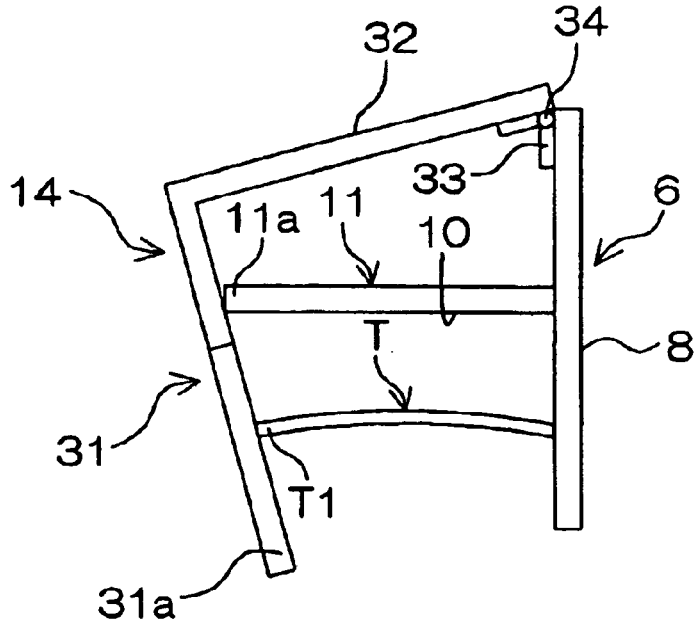

Referring to FIGS. 3A and 3B, the upper plate 32 and the rear flange 8 are pivotally connected to each other so as to be swingable around an axis 34 approximately parallel to an upper edge of the rear flange 8 by a hinge 33 in a state where an edge of the upper plate 32 is approximately parallel to an upper edge of the rear flange 8 of the guide frame 6. The axis 34 extends parallel to the direction of the travel of the tape, and is spaced a predetermined distance apart from the swingable side plate 31.

Consequently, the tape receiving member 14 including the swingable side plate 31 is supported so as to be swingable around the axis 34, and can be displaced to a first position shown in FIGS. 2B and 3B and a second position shown in FIGS. 2A and 3A.

Figure 4A:
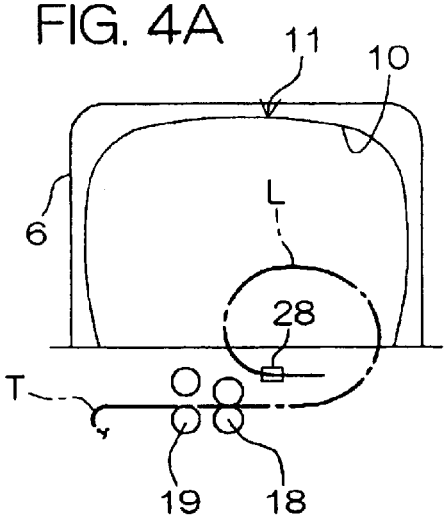
FIGS. 4A to 4F are schematic front views of a binding machine, each showing the steps of the binding process.
Figure 4D:
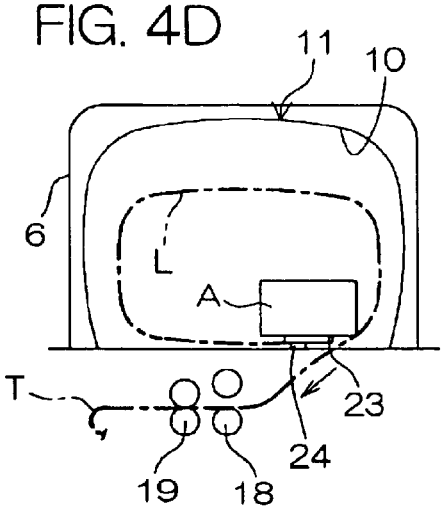
Figure 4B:
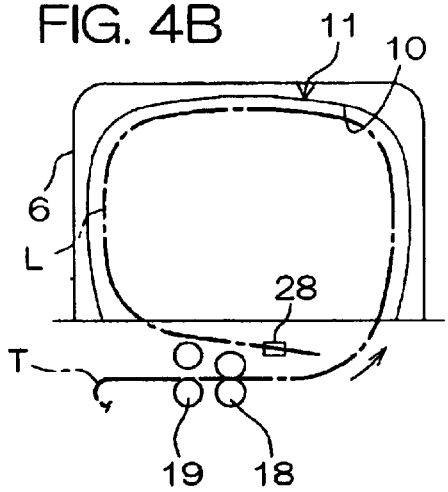
Figure 4E:
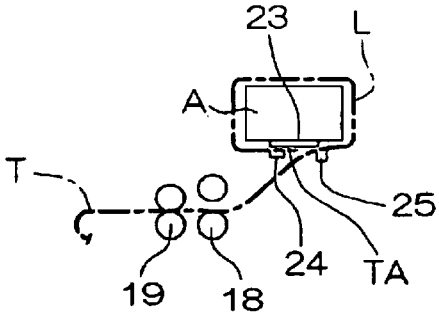
Figure 4C:
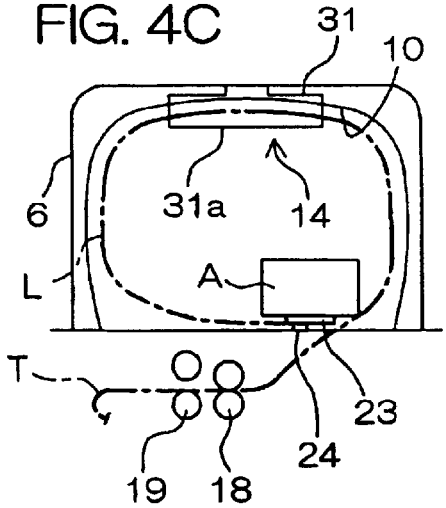

In the first position, the swingable side plate 31 is inclined, and a lower edge 31*a* serving as a lower part of the swingable side plate 31 advances into a loop L formed to a predetermined size along the guiding member 11 as shown in FIG. 4C, and receives a side edge T1 of the tape T at the top of the loop L as shown in FIG. 3B to prevent the top of the tape from hanging.

On the other hand, in the second position retreating from the first position, the swingable side plate 31 is nearly flush with the front flange 7, to allow the travel of the tape for expanding or contracting the loop L, as shown in FIG. 3A. The swingable side plate 31 at the second position shown in FIGS. 2A and 3A not only allows the travel of the tape but also guides the travel of the tape for expanding and contracting the loop L from the side.

Referring to FIGS. 2A and 2B, the driving mechanism 15 for driving the tape receiving member 14 to the first and second positions comprises a cantilever 36 supported so as to be swingable around a support 35, an urging member 37 composed of a tension coil spring, for example, and a solenoid 38.

The cantilever 36 has a first end 36*a* and a second end 36*b*. The first end 36*a* of the cantilever 36 can lift the upper plate 32 of the tape receiving member 14. The urging member 37 urges the first end 36*a* of the cantilever 36 so as to be lowered. The solenoid 38 can lift the first end 36*a* of the cantilever 36 against the urging member 37.

The solenoid 38 has an operating bar 39. The operating bar 39 is connected to the second end 36*b* of the cantilever 36. When a coil inside the solenoid 38 is excited, for example, the solenoid 38 shortens the operating bar 39 against the urging member 37, to lower the second end 36*b* of the cantilever 36 as well as to lift the first end 36*a*. Consequently, the tape receiving member 14 is displaced to the second position shown in FIGS. 2A and 3A.

Conversely, when the excitation of the coil in the solenoid 38 is released, the urging member 37 lowers the first end 36*a* of the cantilever 36. Accordingly, the lifting of the upper plate 32 of the tape receiving member 14 is released. As a result, the tape receiving member 14 is rotated and displaced in a counterclockwise direction in FIG. 3B by its own weight. At this time, the swingable side plate 31 is abutted against a side edge 11*a* of the guiding member 11, so that the side edge 11*a* of the guiding member 11 serves as a stopper, to regulate the tape receiving member 14 to the first position.

The distance between the first end 36*a* and the predetermined support 35 is made larger than the distance between the second end 36*b* and the predetermined support 35. Consequently, the stroke of the upper plate 32 can be amplified with respect to the stroke of the operating bar 39 of the solenoid 38.

Referring to FIGS. 1 again, a tape traveling mechanism for delivering pulling back the tape T is provided below the table 2. The tape traveling mechanism has a delivery roller 18 and a binding roller 19 each composed of a rubber roller. The delivery roller 18 is driven so as to rotate forward (rotate in a clockwise direction), and is used in delivering the tape T in a tape roll 20 serving as a tape winding portion toward an introduction end of the guiding member 11. Further, the binding roller 19 is driven so as to rotate in the opposite direction to the delivery roller 18 (rotate in a counterclockwise direction).

Driven rollers 21 and 22 each made of a metal are respectively arranged just above the delivery roller 18 and the binding roller 19. The driven rollers 21 and 22 are supported by a side plate of the main body of the binding machine 1 so as to be alternately abutted against the delivery roller 18 and the binding roller 19 which respectively correspond thereto. That is, when the tape T is delivered from the tape roller 20, the delivery roller 18 and the driven roller 21 are abutted against each other. At this time, the driven roller 22 is spaced apart from the binding roller 19.

When the tape T is bound upon being tightened around a material to be bound A, the above-mentioned state is reversed, that is, the binding roller 19 and the driven roller 22 are abutted against each other, and the delivery roller 18 and the driven roller 21 separate from each other.

Referring to FIGS. 4A to 4F, a receiving plate 23, being movable back and forth, receives a lower surface of the material to be bound A as well as holds an end of the tape T between the receiving plate and a first clamping member 24. A second clamping member 25 for holding an overlapped portion of the tape T between the second clamping member and a lower surface of the receiving plate 23 is provided. A heating and pressing section 26 for heating and pressing an overlapped portion of the tape T on the lower surface of the receiving plate 23 is provided. A cutter 27 is also provided for cutting the whole width of the tape T after heating and bonding. Further, there is provided a movable holding member 28 for holding the end of the tape T and reversing the end to form a small loop L (see FIG. 4A) by the tape.

Referring now to FIGS. 4A to 4F, a binding operation will be described.

As shown in FIG. 4A, the movable holding member 28 that holds the end of the tape T is reversed, whereby the small loop L is formed at the end of the tape T.

As shown in FIG. 4B, the tape T is then delivered by the delivery roller 18 and the driven roller 21, and is fed along the guide path 10 on the inner periphery of the guiding member 11, thereby expanding the loop L and forming the loop L of a predetermined size, as shown in FIG. 4B. At this time, the tape receiving member 14 is at the second position as shown in FIG. 3A, to allow the travel of the tape for expanding the loop and guide the travel of the tape.

At the point in time where the loop L of the predetermined size is formed by expansion, the end of the tape T is held between the lower surface of the receiving plate 23 and the first clamping member 24 which has advanced, and is stopped as shown in FIG. 4C. Further, at the point in time where the loop L of the predetermined size is formed, the tape receiving member 14 is moved to the first position to advance into the loop L, thereby preventing the top of the tape from hanging. In this state, the material to be bound A is put on an upper surface of the receiving plate 23 which has advanced into the groove, as shown in FIG. 4C.

After the material to be bound A is put on the upper surface, the tape receiving member 14 retreats to the second position, thereby entering a state where the tightening of the loop is allowed. In order to detect that the material to be bound A is put on the receiving plate 23, sensing means such as an optical sensor may be provided in the passage groove 3, or a user may press a switch indicating that the placement is completed after the material to be bound A is put on the upper surface, to start the tightening of the loop as the switch is pressed.

As shown in FIG. 4D, the tape T is then pulled back by the binding roller 19, so that the loop is contracted. When the loop is further contracted, the tape T surrounds the material to be bound A in a dense state, as shown in FIG. 4E. Thereafter, the end of the tape T and the winding end portion of the tape T are overlapped with each other, to be clamped between the lower surface of the receiving plate 23 and the second clamping member 25.

Figure 4F:
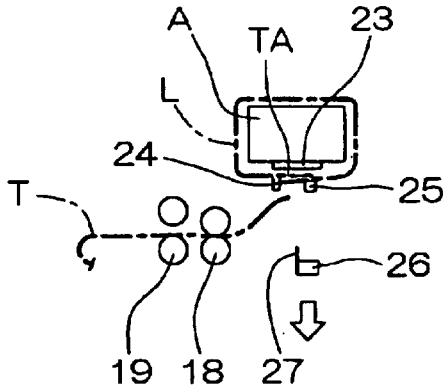

As shown in FIG. 4F, the heating and pressing section 26 with the cutter 27 then heats an overlapped portion TA of the tape T while pressing the overlapped portion against the lower surface of the receiving plate 23 to heat and bond the overlapped portion, and the cutter 27 cuts the tape T. Thereafter, the receiving plate 23 retreats, thereby completing the binding.

According to the present embodiment described above, the loop L of the predetermined size is formed by the tape T along the guiding member 11, and the tape receiving member 14 which has advanced to the first position then prevents the top of the loop from hanging. Consequently, the shape of the loop L of the predetermined size can be reliably maintained, and the material to be bound A is smoothly arranged in the loop L, thereby making it possible to efficiently perform the binding operation.

In a state where the tape receiving member 14 is at the first position, the swingable side plate 31 is inclined, and the side edge T1 of the tape T is received from the side by the lower edge 31*a* of the swingable side plate 31, as shown in FIG. 3B, which is sufficient to receive the tape T which is very lightweight. Further, the amount of displacement of the tape receiving member 14 which is displaced to the first and second positions can be reduced, thereby increasing the degree of freedom of the design of the driving mechanism 15.

When the tape receiving member 14 is at the second position, as shown in FIG. 3A, the swingable side plate 31 performs the function of guiding the travel of the tape for expanding and contracting the loop L from the side. Accordingly, the reliability of the binding operation is high.

The tape receiving member 14 can be urged to the first position by its own weight, as shown in FIG. 3B, thereby making it possible to simplify the construction.

Furthermore, the solenoid 38 is used for the driving mechanism 15. Therefore, it is easy to cause the tape receiving member 14 to perform an operation in timing with the binding operation.

The driving mechanism can be a fluid pressure cylinder such as an air cylinder or a hydraulic cylinder, in addition to the solenoid.

While the invention has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A binding machine with a tape, which binds a material to be bound arranged inside a loop formed by a tape by contracting the loop, comprising:

a tape traveling mechanism that can cause the tape to travel in order to expand and contract the boo formed by the tape;

a table on which the material to be bound can be mounted;

a tape passage groove formed on the table;

a guiding member in an arch shape provided above the tape passage groove, the guiding member regulating an expanded loop to a predetermined size from an outside of the expanded loop;

a tape receiving member that can be displaced to a first position where at least a part thereof advances into the expanded loop to prevent the tape at a top of the loop from hanging and a second position where the part retreats outward from the expanded loop; and a driving mechanism that drives the tape receiving member in order to displace the tape receiving member to the first and second positions, wherein the tape receiving member comprises a swingable side plate supported so as to be swingable around an axis extending in a direction parallel to a direction of a travel of the tape at the top of the loop.

2. The binding machine with a tape according to claim 1, wherein the swingable side plate is inclined when the tape receiving member is at the first position, and stands nearly upright when it is at the second position.

3. The binding machine with a tape according to claim 2, wherein a side edge of the tape at the top of the expanded loop is received by a lower portion of the inclined swingable side plate when the tape receiving member is at the first position.

4. The binding machine with a tape according to claim 2, wherein a side part of the tape traveling in order to expand and contract the loop is guided by the swingable side plate standing nearly upright when the tape receiving member is at the second position.

5. The binding machine with a tape according to claim 2, wherein the tape receiving member further comprises an upper plate extending in a direction crossing the swingable side plate from an upper end of the swingable side plate.

6. The binding machine with a tape according to claim 5, wherein the axis is arranged along the upper plate at a position spaced a predetermined distance apart from the swingable side plate, and the tape receiving member is urged to the first position by a weight of the swingable side plate.

7. The binding machine with a tape according to claim 2, wherein the inclined swingable side plate is abutted against a side edge of the guiding member so that the tape receiving member is put at the first position.

8. The binding machine with a tape according to claim 5, herein the driving mechanism comprises a solenoid capable of raising or lowering the upper plate.

9. The binding machine with a tape according to claim 8, wherein the driving mechanism comprises a cantilever which is swingable around a predetermined support, and the solenoid raises and lowers the upper plate through the cantilever.

10. The binding machine with a tape according to claim 9, wherein the cantilever comprises a first end for lifting the upper plate and a second end engaged with the solenoid, and wherein a distance between the first end and the predetermined support is larger than a distance between the second end and the predetermined support.

11. The binding machine with a tape according to claim 1, wherein the driving mechanism comprises a solenoid.

* * * * *